US010184648B2

(12) United States Patent
Hall

(10) Patent No.: US 10,184,648 B2
(45) Date of Patent: Jan. 22, 2019

(54) ADJUSTABLE AND RECONFIGURABLE LIGHT SOURCE

(71) Applicant: LEDVANCE LLC, Wilmington, MA (US)

(72) Inventor: Simon Hall, Boulder, CO (US)

(73) Assignee: TerraLUX, Inc., Longmont, CO (US)

( * ) Notice: Subject to any disclaimer, the term of this patent is extended or adjusted under 35 U.S.C. 154(b) by 111 days.

(21) Appl. No.: 15/146,748

(22) Filed: May 4, 2016

(65) Prior Publication Data

US 2016/0327256 A1 Nov. 10, 2016

Related U.S. Application Data

(60) Provisional application No. 62/156,353, filed on May 4, 2015.

(51) Int. Cl.

| | |
|---|---|
| ***F21V 23/00*** | (2015.01) |
| ***F21V 23/06*** | (2006.01) |
| ***F21S 4/28*** | (2016.01) |
| ***F21S 8/00*** | (2006.01) |
| ***F21S 8/04*** | (2006.01) |
| ***F21V 29/503*** | (2015.01) |
| ***F21V 21/005*** | (2006.01) |
| *F21Y 103/10* | (2016.01) |
| *F21Y 115/10* | (2016.01) |

(52) U.S. Cl.

CPC ..... *F21V 23/009* (2013.01); *F21S 4/28* (2016.01); *F21S 8/036* (2013.01); *F21S 8/043* (2013.01); *F21V 21/005* (2013.01); *F21V 23/002* (2013.01); *F21V 23/06* (2013.01); *F21V 29/503* (2015.01); *F21Y 2103/10* (2016.08); *F21Y 2115/10* (2016.08)

(58) Field of Classification Search

CPC ..... F21Y 2115/10; F21Y 2103/10; F21V 23/007; F21V 23/009; F21S 2/005; F21S 4/28

See application file for complete search history.

(56) References Cited

U.S. PATENT DOCUMENTS

| | | | | |
|---|---|---|---|---|
| 8,267,544 | B2 * | 9/2012 | Zheng | F21S 2/005 362/249.02 |
| 2017/0175982 | A1 * | 6/2017 | Lax | F21V 17/002 |

* cited by examiner

*Primary Examiner* — Robert May
(74) *Attorney, Agent, or Firm* — Neugeboren O'Dowd PC

(57) ABSTRACT

This disclosure describes systems, methods, and apparatus for a customizable and modular LED lighting system. The LED lighting system can include an LED driver coupled to a light run and held rigidly relative to each other via a carrier. A mounting bracket can also attach to the LED driver and/or the light run and can affix the LED lighting system to a junction box. The light run can include a thermally conductive frame, sometimes having a "V"-shape and having two surfaces on an upper portion thereof. A substrate comprising a string of electrically-coupled LEDs can be affixed to each of the two surfaces. The LEDs can be driven by the LED driver and can be coupled to each other serially via one or more electrical connectors.

15 Claims, 20 Drawing Sheets

ADJUSTABLE AND RECONFIGURABLE LIGHT SOURCE

CLAIM OF PRIORITY UNDER 35 U.S.C. § 119

The present Application for patent claims priority to Provisional Application No. 62/156,353 entitled "Adjustable and Reconfigurable Light Source" filed May 4, 2015, and assigned to the assignee hereof and hereby expressly incorporated by reference herein.

FIELD OF THE DISCLOSURE

The present disclosure relates generally to LED lighting. In particular, but not by way of limitation, the present disclosure relates to systems, methods and apparatuses for a modular LED lighting fixture.

DESCRIPTION OF RELATED ART

Light fixtures come in many forms; the variety may make the design of LED light engines and light sources for use therewith difficult. There is no one-size-fits-all approach that has so far proven useful. In order to reduce cost and increase flexibility it is desirable to have a design that is easily and affordably reconfigurable so as to provide uniform, shadow-free lighting of the fixture. Ideally the individual components of such a light source are assembled and adjusted to meet the requirements of several different classes of fixtures. A need therefore exists for such a design.

SUMMARY OF THE DISCLOSURE

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

Some embodiments of the disclosure may be characterized as an LED lighting system having an LED encased in an LED driver casing, a first thermally conductive frame, two substrate each having a plurality of electrically-coupled LEDs, first and second electrical connectors, a carrier, and a mounting bracket. The LED driver casing can include an elongated mounting flange on at least two of four edges of the LED driver casing. The first thermally conductive frame can have an elongate shape extending away from the LED driver and having a V-shaped cross section, thereby forming at least two top surfaces oblique to each other, the first thermally conductive frame further comprising two elongated mounting flanges along elongated edges of the first thermally conductive frame. The two substrates can each include a plurality of electrically-coupled LEDs, and can each be affixed to the at least two top surfaces of the first thermally conductive frame. The first electrical connector electrically couples to a first of the two substrates and is configured for electrical connection to the LED driver. The second electrical connector can be electrically coupled between the two substrates and at an end of the substrates distal from the first electrical connector.

Other embodiments of the disclosure may also be characterized as a method of providing an LED lighting system. The method can include providing an LED driver encased in an LED driver casing, the casing including an elongated mounting flange on at least two of four edges of the LED driver casing. The method can also include providing a first thermally conductive frame having an elongate shape extending away from the LED driver and having a V-shaped cross section, thereby forming at least two top surfaces oblique to each other. The first thermally conductive frame can also include two elongated mounting flanges along elongated edges of the first thermally conductive frame. The method can also include providing two substrates each comprising a plurality of electrically-coupled LEDs, where the two substrates can be affixed to the at least two top surfaces of the first thermally conductive frame. The method can further include providing a first electrical connector electrically coupled to a first of the two substrates and configured for electrical connection to the LED driver. The method can yet further include providing a second electrical connector electrically coupled between the two substrates and at an end of the two substrates distal from the first electrical connector. The method can also include providing a carrier removably coupled to the elongated mounting flanges of both the LED driver and the first thermally conductive frame. The method can additionally include providing a mounting bracket removably engaged with one or both of the LED driver and the first thermally conductive frame, the mounting bracket configured for coupling to a junction box.

Other embodiments of the disclosure can be characterized as an LED lighting system having an LED driver, a first thermally conductive frame, two sets of electrically-coupled LEDs, a first electrical connector, a second electrical connector, a carrier, and a mounting bracket. The LED driver can include elongated mounting flanges. The first thermally conductive frame can have an elongate shape and can have a V-shaped cross section and two oblique top surfaces thereon. The first thermally conductive frame further can include two elongated mounting flanges parallel to a longitudinal axis of the thermally conductive frame. The two sets of electrically-coupled LEDs can be affixed to the two oblique top surfaces of the thermally conductive frame. The first electrical connector can be affixed to the first thermally conductive frame and configured to provide a removable electrical connection between one of the two sets of electrically-coupled LEDs and the LED driver. The second electrical connector can be removably coupled to the two sets of electrically-coupled LEDs, thereby forming an electrical connection between the two sets of electrically-coupled LEDs, the second electrical connector arranged on an opposing end of the frame from the first electrical connector. The carrier can removably couple to the elongated mounting flanges of both the LED driver and the first thermally conductive frame, thereby providing a rigid orientation between the LED driver and the first thermally conductive frame. The mounting bracket can removably couple to one or both of the LED driver and the first thermally conductive frame, and the mounting bracket can be configured for coupling to a junction box.

BRIEF DESCRIPTION OF THE DRAWINGS

Various objects and advantages and a more complete understanding of the present disclosure are apparent and more readily appreciated by referring to the following detailed description and to the appended claims when taken in conjunction with the accompanying drawings:

DETAILED DESCRIPTION

The present disclosure relates generally to a lighting system. More specifically, but without limitation, the present disclosure relates to a modular and customizable LED lighting system.

The word "exemplary" is used herein to mean "serving as an example, instance, or illustration." Any embodiment described herein as "exemplary" is not necessarily to be construed as preferred or advantageous over other embodiments.

Figure 1:
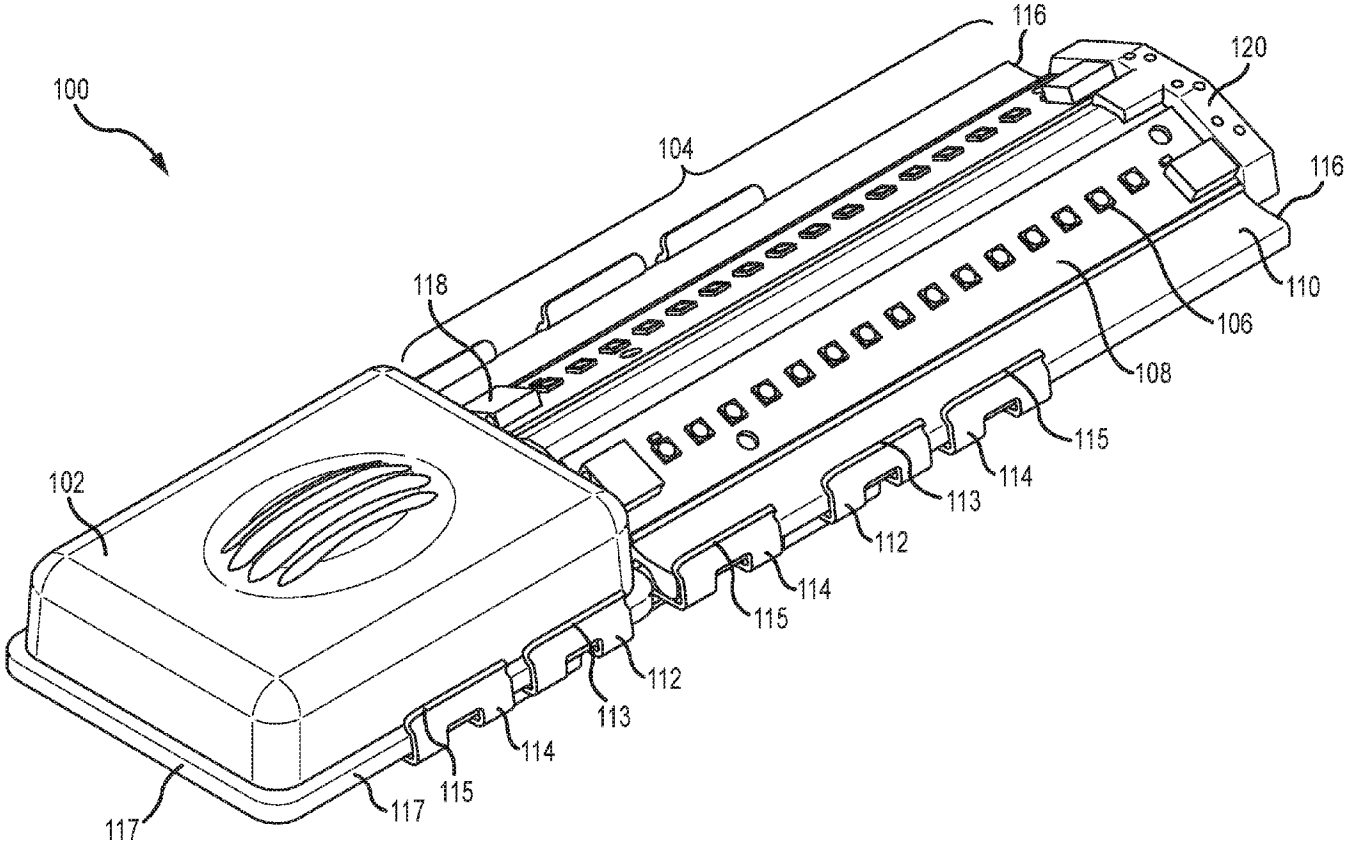
FIG. 1 illustrates an embodiment of a modular LED lighting system with an LED driver and a single light run comprising two strips of LEDs affixed to a "V"-shaped frame.

FIG. 1 illustrates an embodiment of a modular LED lighting system 100 with an LED driver 102 and a single light run 104 comprising two strips 108 of LEDs 106 affixed to a "V"-shaped frame 110. The "V"-shaped cross section of the LED light run 104 enables the two strips of LEDs 106, or the substrates 108 (e.g., PCB) on which the LED's 106 are affixed, to be arranged, one on each of two surfaces of the "V"-shaped frame 110 that are oblique to each other. The LEDs 106 can be electrically coupled and can be arranged linearly, as shown, or in any other arrangements. The substrates 108 can be secured to or fixed to the "V"-shaped frame 110, for instance via an adhesive or fasteners. The frame 110 can be formed from a thermally conductive material (and thus can be a thermally conductive frame 110), such as metal, and can be shaped to disperse heat from the substrates 108. For instance, the frame 110 can have a width that extends beyond the dimensions of the substrates 108, thereby providing greater surface area contact with the air and also providing contact areas with the air that are somewhat removed from the substrates 108. The frame 110 can have an elongate shape and can extend away from the LED driver 102. The LED driver 102 and one of the substrates 108 can be in electrical communications, with the LED driver 102 providing a constant current to drive the LEDs 106. One or both of the substrates 108 can have a first electrical connector 118, arranged on an end of the substrate 108 proximal to the LED driver 102, electrically coupled to the LEDs 106 directly or via the substrate 108, and configured to removably couple to the LED driver 102, and to thereby electrically couple the LED driver 102 to an electrical contact of one of the substrates 108. On distal ends of the substrates 108, a second electrical connector 120 can be removably engaged with the substrates 108 and the frame 110. When engaged with the substrates 108, the second electrical connector 120 can be electrically coupled between the two strings of LEDs 106, either directly or via the substrates 108. The second electrical connector 120 can have a "U"-shape or any other shape enabling it to engage electrical contacts on both substrates 108 and provide an electrical connection between the distal ends of the strings of LEDs 106. These various electrical connections can either be fixed (e.g., via soldering) or removably engaged (e.g., a plug and socket configuration). One advantage of removably engaged connections, is that the LED driver 102 and the frame 110 can be detached and reattached easily without tools. Thus, the LED driver 102 provides a constant current to a first electrical connector 118, which then provides the constant current through a first of the two strings of LEDs 106, then through the second electrical connector 120, and to the second of the two strings of LEDs 106.

Although the frame 110 is preferably made from a thermally conductive material such as metal, it can also be made from plastic, ceramic, a composite, or any other material or combination of materials. The frame 110 can be made via extrusion, stamping, or any other way. In one embodiment, the frame 110 is thermally conductive and acts as a heat sink for the LEDs 106 and the substrates 108. The substrates 108 and the frame 110 may be joined by any means, such as adhesives or fasteners (e.g., screws or bolts), to name two non-limiting examples. The frame 110 can absorb heat from the substrates 108 and disperse the heat via an underside of the frame 110 and via edges of the frame 110 (e.g., via the elongated mounting flanges 116), and thereby help to cool the LEDs 106.

The "V"-shaped frame 110 as well as the LED driver 102 can have elongated mounting flanges 116, 117 on elongated edges of the frame 110 that enable a mounting bracket 112 and a carrier 114 to removably engage to these elongated mounting flanges 116, 117, for instance via a snap fit. Alternatively, the elongated mounting flanges 116, 117 can make sliding engagement with the mounting bracket 112 and carrier 114. The mounting bracket 112 and the carrier 114 can engage with any portion of these elongated mounting flanges 116, 117, thereby enabling the LED driver 102 and the light run 104 to be arranged in a variety of positions relative to the mounting bracket 112 as illustrated, for instance, in FIGS. 2-4. By engaging both the LED driver 102 and the frame 110, the carrier 114 can provide a rigid support for the LED driver 102 and the frame 110 and can maintain a rigid orientation between the LED driver 102 and the frame 110.

Since the mounting bracket 112 mounts to a junction box, often found permanently installed in a wall or ceiling, the ability for the LED driver 102 and the frame 110 to removably engage the mounting bracket 112 and the carrier 114 at various positions, enables the LED driver 102 and the frame 104, and hence the LEDs 106, to be arranged in various positions where a traditional light fixture would be limited to the position dictated by the junction box.

In one embodiment, a feature of the frame 110 (e.g., elongated mounting flanges 116) can mate with a corresponding feature in the mounting bracket 112 (e.g., attachment points 113, 115) and the carrier 114 to thereby allow movement along one dimension therebetween while otherwise holding the frame 110 in place with respect to the mounting bracket 112 and the carrier 114. The mating may be such that motion along any other axis is prohibited. Friction and/or a springing force between the frame 110 and the mounting bracket 112 and between the frame 110 and the carrier 114 may involve a certain minimum level of force in order to move the frame 110 relative to the mounting bracket 112 and the carrier 114 with respect to each other. The LED driver 102 may be similarly slidably attached to the mounting bracket 112 and the carrier 114. The elongated mounting flanges 116, 117 of the frame 110 and the LED driver 102 can be similar in shape and size.

Figure 2:
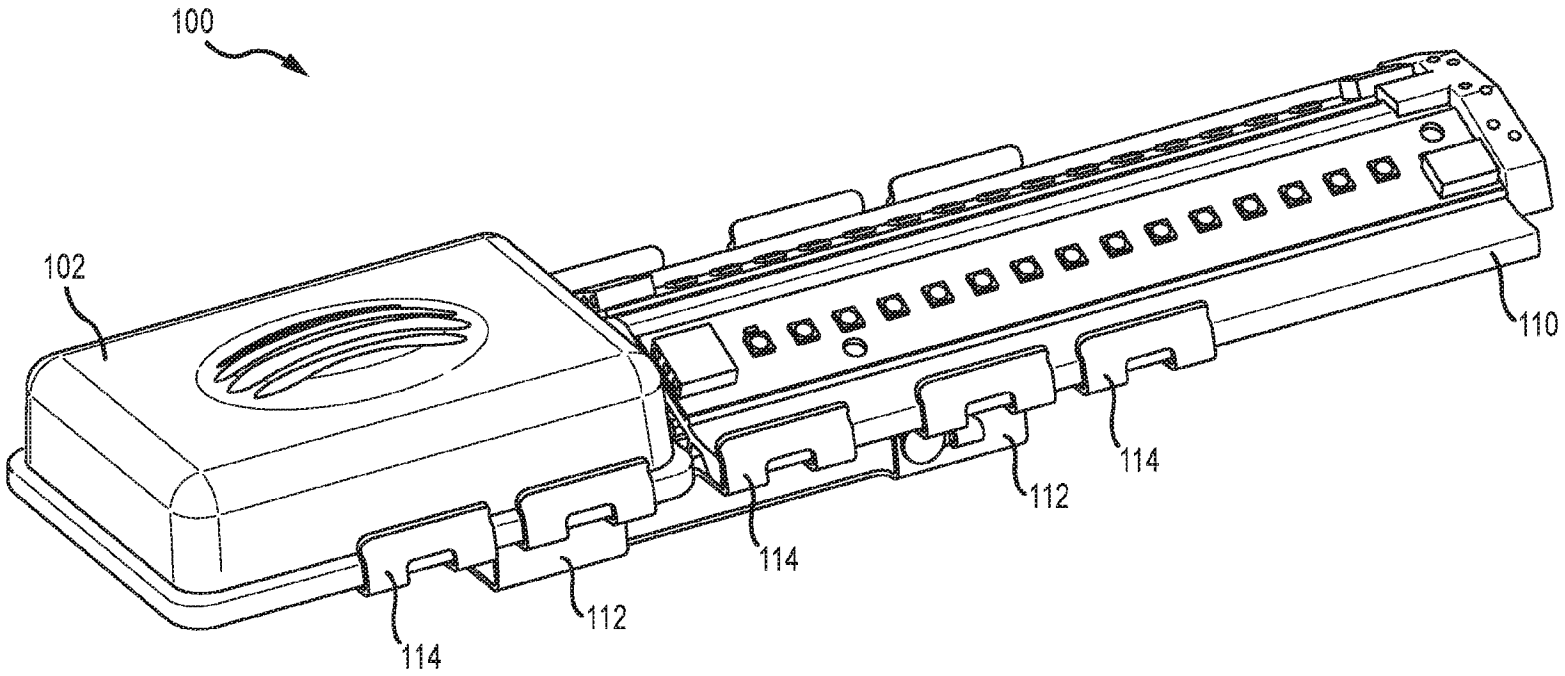
FIG. 2 illustrates the modular LED lighting system of FIG. 1 with an alternative position of the mounting bracket.
Figure 3:
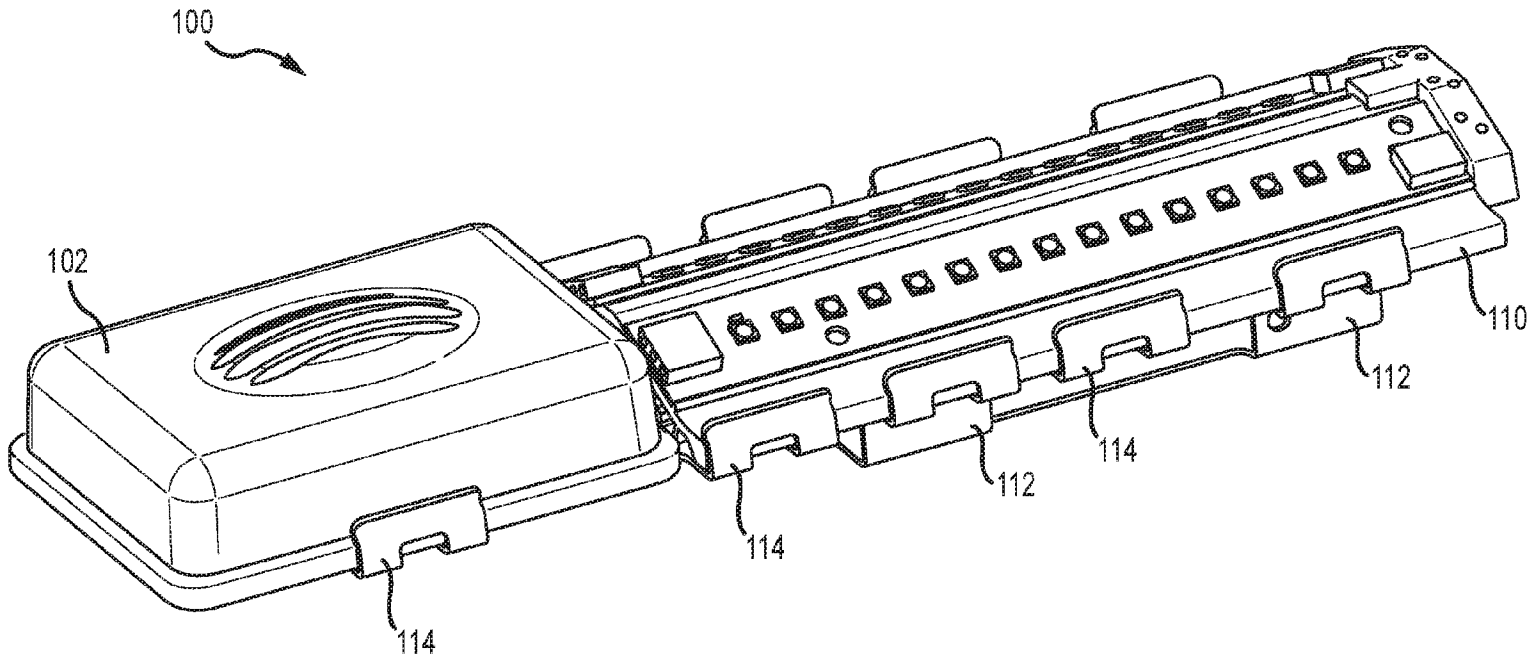
FIG. 3 illustrates the modular LED lighting system of FIG. 1 with another alternative position of the mounting bracket.
Figure 4:
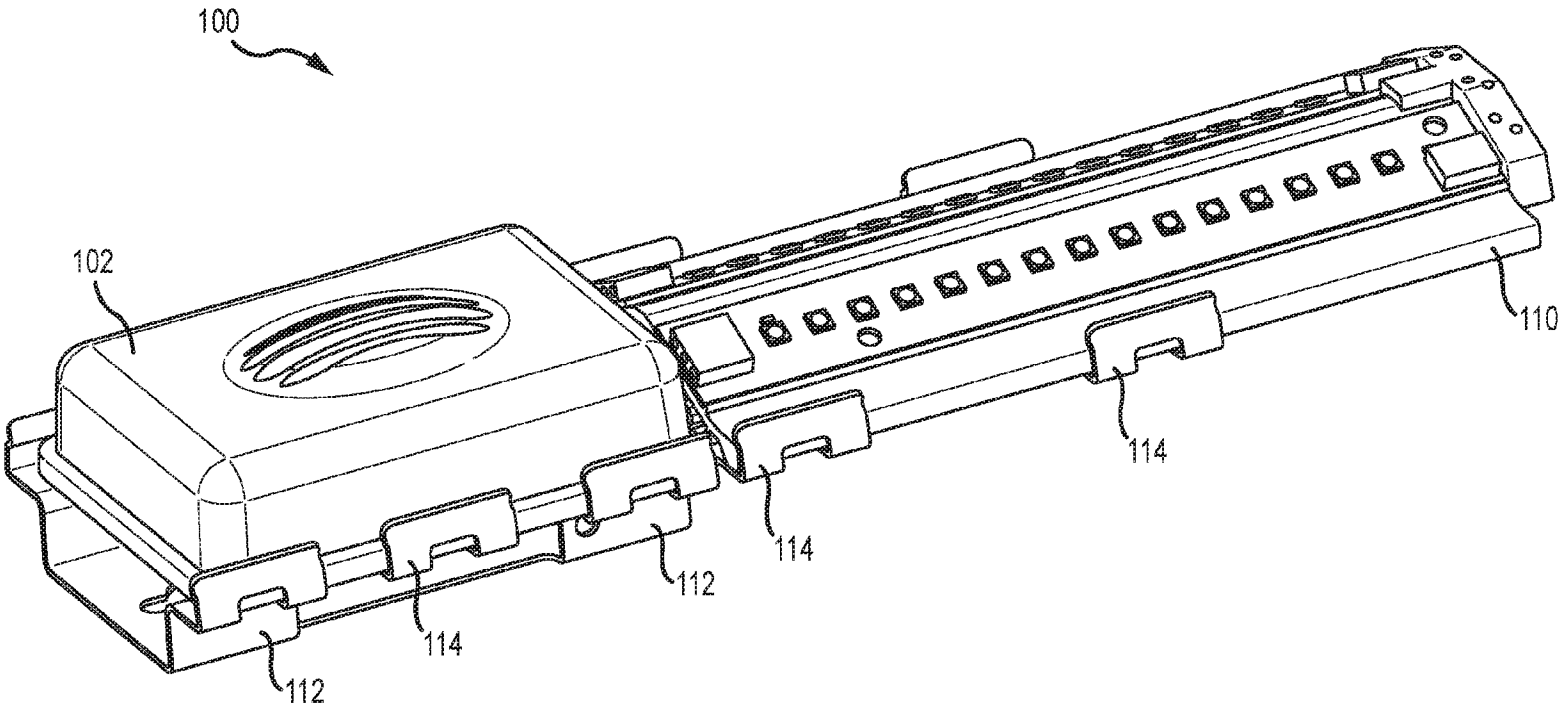
FIG. 4 illustrates the modular LED lighting system of FIG. 1 with yet another alternative position of the mounting bracket.

While the mounting bracket 112 is typically fixed in position relative to the wall/ceiling (e.g., as dictated by the location of the junction box), the mounting bracket 112 can engage different portions of the LED driver 102 and the frame 110 to achieve different lighting configurations. FIGS. 2-4 illustrate three embodiments of such positions. While prior art light fixtures have a fixed location relative to the wall/ceiling (e.g., relative to a junction box), there is flexibility and customizability in the position of the light run 104 relative to the junction box since the LED driver 102 and the light run 104 can be moved relative to the mounting bracket 112. For instance, FIG. 2 illustrates a configuration where an end of the frame 110 proximal to the LED driver 102 is arranged over the mounting bracket 112, and thus over the junction box or other attachment point to the wall/ceiling. FIG. 3, on the other hand, shows the mounting bracket 112 arranged more toward an end of the frame 110 distal to the LED driver 102. FIG. 4 shows the mounting bracket 112 arranged almost entirely under the LED driver 102, such that the LEDs 106 are arranged further from the junction box than the arrangements of FIGS. 2 and 3. From these examples, it can be readily appreciated that the mounting bracket 112 may slide along the LED driver 102 and the frame 110, or be engaged at different positions along the LED driver 102 and the frame 110 to accommodate various light fixture designs. The ability to alter the position of the LEDs 106 and the LED driver 102 is especially important since an installer or user may wish to customize the position of the lighting system within the light fixture, and prior art light engines are typically restricted to a single location dictated by the junction box or other connection to the wall/ceiling.

Although the illustrated mounting bracket 112 has four attachment points 113 and the carrier 114 has six attachment points 115, these numbers are not limiting, and in other embodiments more or fewer attachments points for one or both of these components is envisioned. For instance, both the carrier 114 and the mounting bracket 112 could both have four attachment points, or could both have six attachment points, to name two non-limiting examples. The attachment points 113, 115 can deform when pressed against the elongated mounting flanges 116, 117 from underneath the LED driver 102 and the light run 104, until they snap closed atop the elongated mounting flanges 116, 117. They can then deform when being pulled off of the elongated mounting flanges 116, 117. The mounting bracket 112 and the carrier 114 can also be slidingly engaged with and removed from the elongated mounting flanges 116, 117. While the attachment points 113, 115 may be deformable, in some embodiments, they may be rigid (e.g., where engagement of the carrier 114 and the mounting brackets 112 is via a sliding engagement rather than a snap-fit engagement.

In some embodiments, the carrier 114 can be fixed to the frame 110 and fixed to the LED driver 102 and slidably attached to the mounting bracket 112. In this embodiment, the LED driver 102 and the frame 110 can still slide along the mounting bracket 112, while the carrier 114 provides a rigid support for the LED driver 102 and the frame 110 and maintains a rigid orientation between the LED driver 102 and the frame 110.

Figure 15:
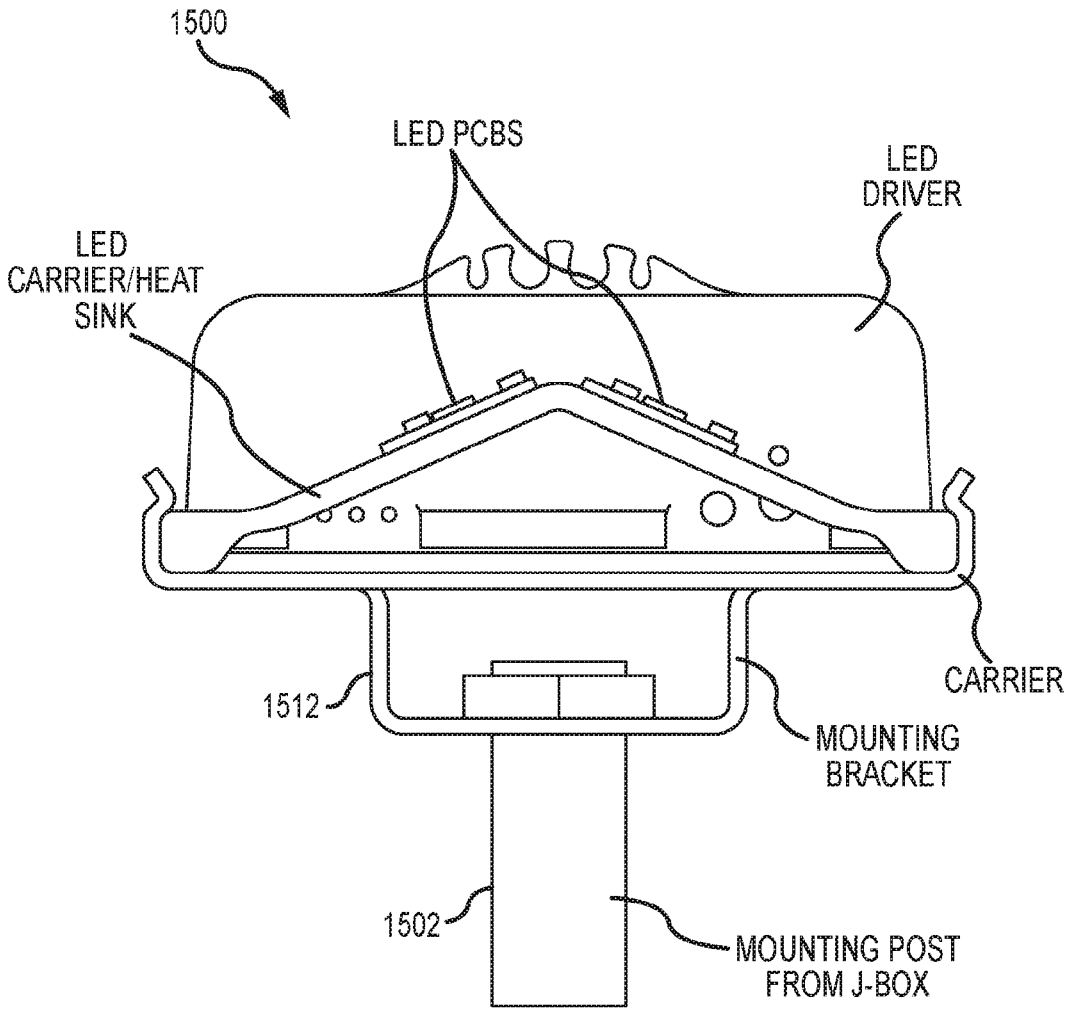
FIG. 15 illustrates a cross sectional view of a modular LED lighting system with a mounting post, according to one embodiment of this disclosure.
Figure 16:
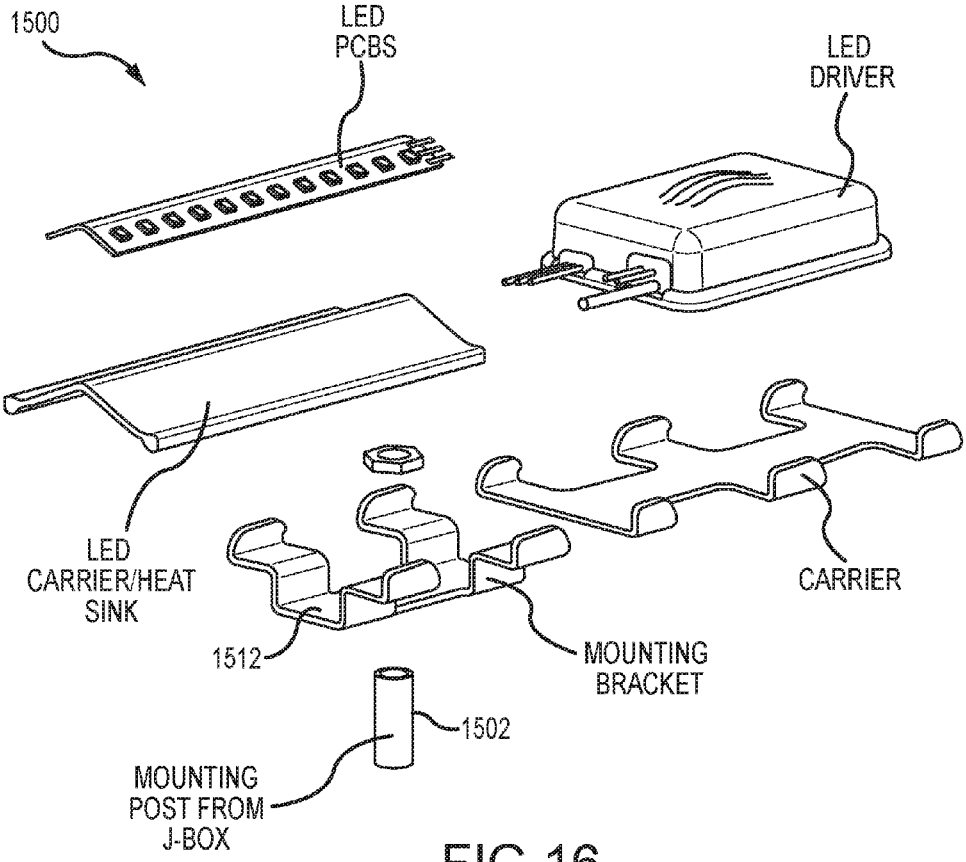
FIG. 16 illustrates an exploded view of an embodiment of a modular LED lighting system having an LED driver, a light run, and a mounting post.
Figure 17:
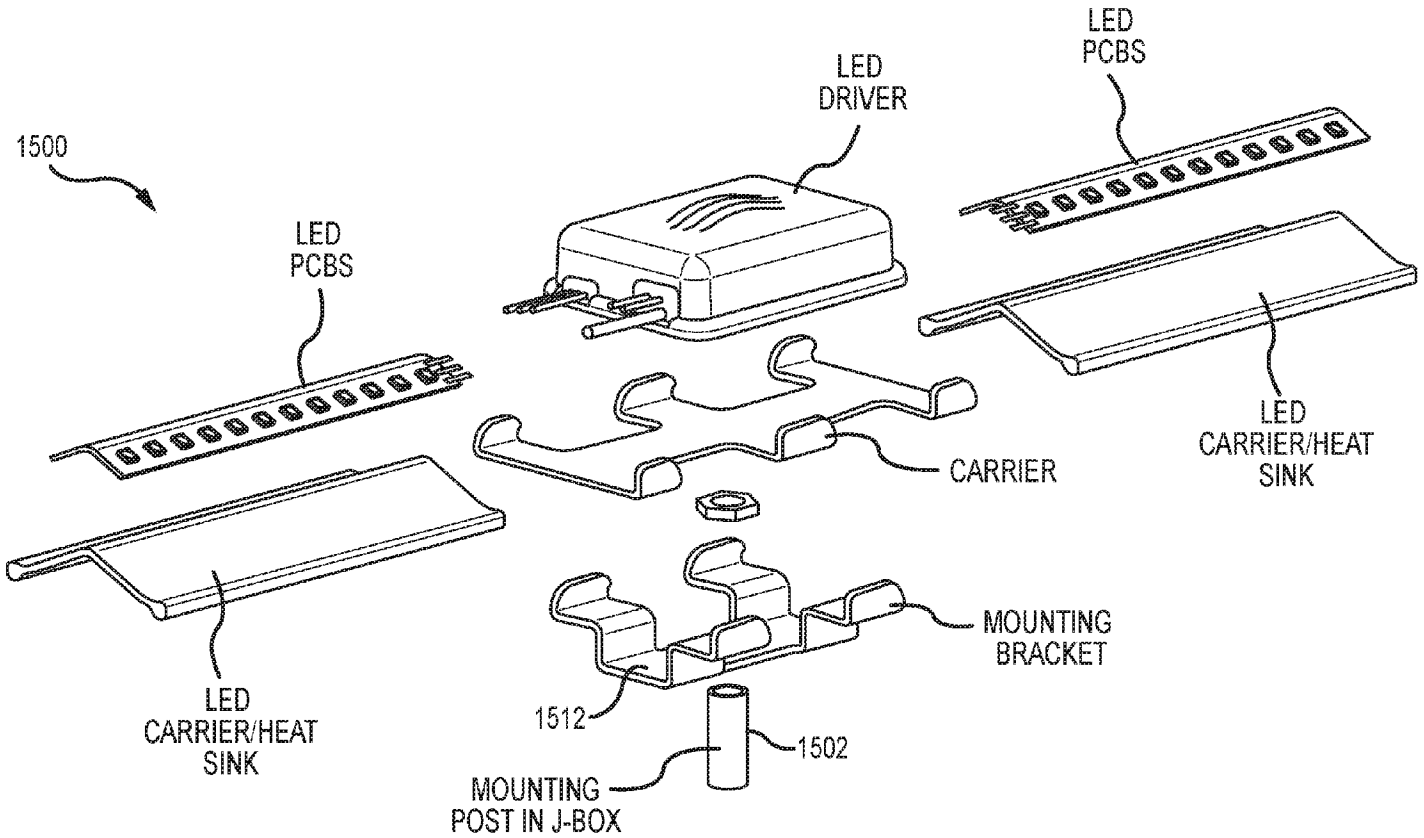
FIG. 17 illustrates an exploded view of another embodiment of a modular LED lighting system having an LED driver, two light runs, and a mounting post.

In some embodiments, the mounting bracket 112 allows the lighting system 100 to be mounted over a junction box that contains line voltage wires and allows them to pass into the LED lighting system's 100 LED driver 102. For instance, the mounting bracket 112 can include one or more apertures 122 (see FIG. 20) through which wires may pass from the junction box to the LED driver 102. The mounting bracket 112 can be mounted to a junction box via fasteners (e.g., screws or bolts) or via a mounting post 124 as illustrated in FIGS. 15-17. Where multiple apertures 122 exist in the mounting bracket 112, the mounting post 124 can be affixed to or through any of the apertures 122, thereby enabling further customization of the positioning of the LED lighting system 100.

Because the mounting bracket 112 can be attached to and removed from the LED driver 102 and the frame 110, the mounting bracket 112 can be affixed to the junction box first, and then the LED driver 102 and the frame 110 can be attached to the mounting bracket 112. This can make it easier for an installer to make electrical connections between the junction box and the LED driver 102.

In the art, LED drivers often cast a shadow when the LEDs are turned on. The arrangement of the herein disclosed low-profile LED driver 102 next to the frame 110 greatly reduces such a shadow especially since LEDs 106 distal from the LED driver 102 mostly wash out any shadow cast by LEDs 106 proximal to the LED driver 102.

As noted above, the frame 110, in some embodiments, can have a "V"-shaped cross-section. This arrangement, along with the use of two strings of LEDs 106 on both of the outward facing oblique surfaces on a top of the frame 110, allows light to cover an area greater than 180 degrees, and thus illuminate a fixture whose cover subtends an arc of greater than 180 degrees, without creating a shadow. This shape also enables a wider dispersion of light than a single row of LEDs 106, or two rows oriented in the same direction, could achieve. Electrical wires can run between the underside of the frame 110 and the carrier 114, in the "V"-shaped volume therebetween.

Figure 5:
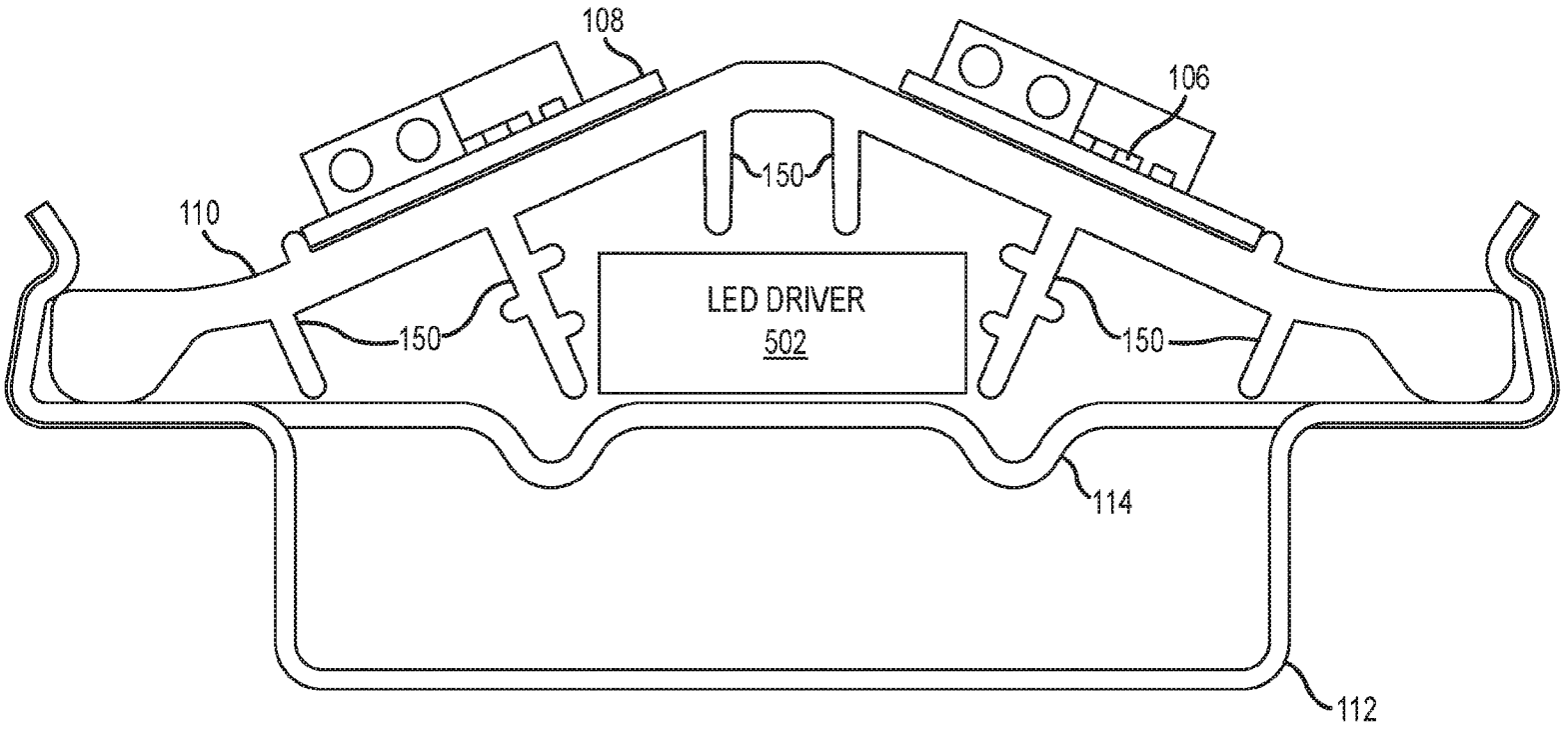
FIG. 5 illustrates a cross-sectional view of a light run including an LED driver between a frame and a carrier.
Figure 6:
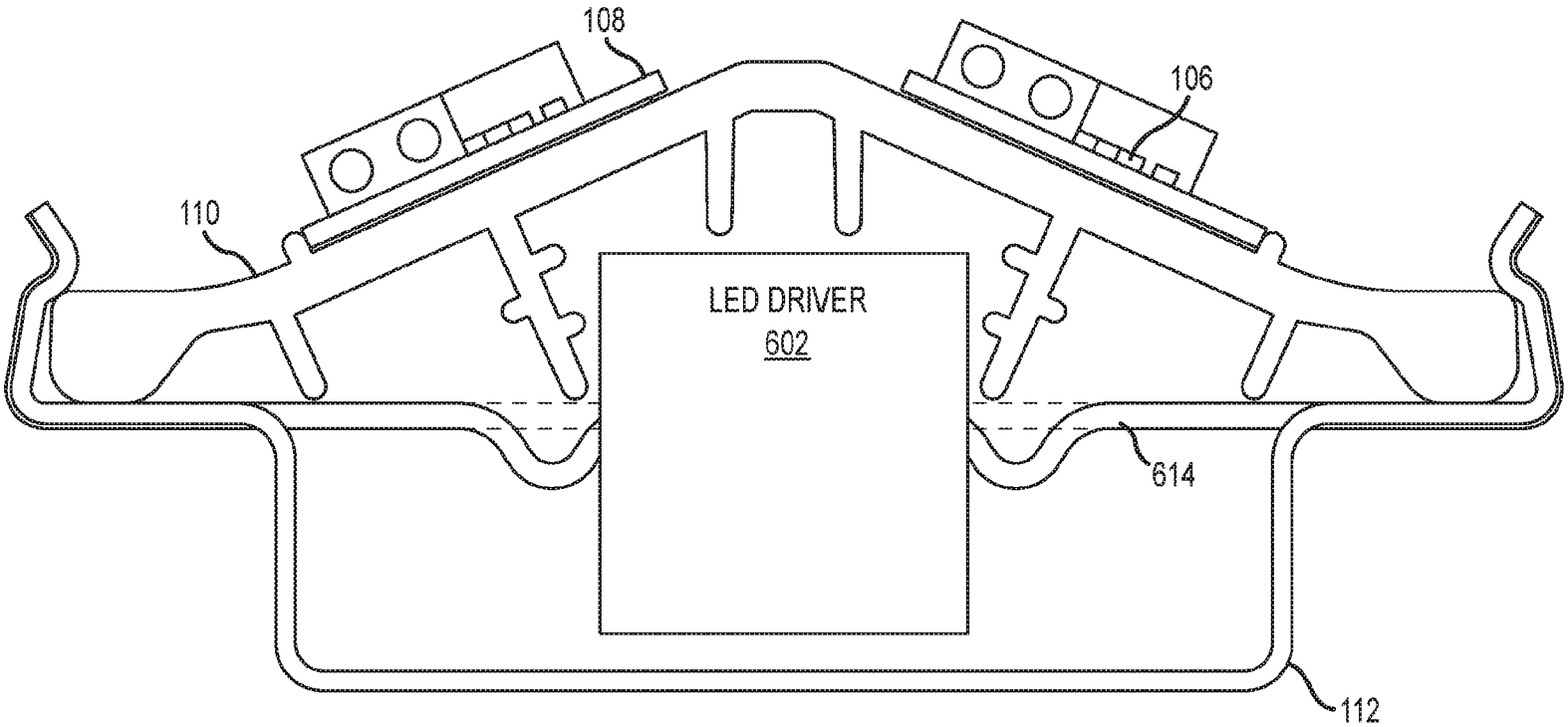
FIG. 6 illustrates a cross-sectional view of another light run including an LED driver between a frame and a mounting bracket.

In some embodiments, the LED driver 102 can be arranged under the frame 110, thereby eliminating any shadows (see for example, FIGS. 5-6). In such an embodiment, the LED driver 102 may take on a smaller form factor such that it can fit in the "V"-shaped volume between the frame 110 and the carrier 114. In some embodiments, the carrier 114 may include an opening or aperture allowing a larger form factor LED driver 102 to fit partially through the carrier 114 (e.g., FIG. 6). FIG. 5 shows an embodiment where an LED driver 502 is arranged between the frame 110 and the carrier 114. FIG. 6 shows an embodiment where an LED driver 602 is arranged below the frame 110 and partially passing through an aperture in the carrier 614 (FIG. 5).

The frame 110 can include one or more heat fins 150 and in FIGS. 5-6 the frame 110 is illustrated as including six heat fins. The heat fins 150 can extend from a bottom of the frame 110 and can be perpendicular to a portion of the frame 110 from which each heat fin 150 extends. The frame 110 and the carrier 114 can form a triangular volume therebetween and the heat fins 150 can extend a majority of the vertical distance through the triangular volume. Where the LED driver 502, 602 is arranged within this triangular volume, one or more of the heat fins 150 can extend a shorter distance through the triangular volume so as to make room for and not impinge on the LED driver 502, 602.

Returning to FIG. 1, the first electrical connector 118 can be fixedly mounted to one of the substrates 108 and optionally also the frame 110. As illustrated, there is one first electrical connector 118 for each of the two substrates 108. However, in some embodiments, only a single first electrical connector 108 can be used (since only one string of LEDs 106 need be electrically coupled to the LED driver 102). The first electrical connector 118 can be removably coupled to the LED driver 102, thereby selectively forming an electrical connection between one of the substrates 108 and the LED driver 102. By this it is meant, that the light run 104 can be selectively removed from and attached to the LED driver 102, thereby making and breaking electrical connection with the LED driver 102 via the first electrical connector 118. This enables light runs 104 to be modular and allows different light runs 104 to be attached to the LED driver 102. For instance, where a light run 104 goes bad, a new light run 104 can be removably engaged with the LED driver 102, thereby avoiding the cost of replacing the entire LED lighting system 100. Alternatively, a different light run 104 may have different characteristics (e.g., LED color), and therefore switching of light runs 104 may parallel the temporary switching of light bulbs in typical light fixtures.

The second electrical connector 120 can also be removably engaged with the substrates 108 and the frame 110. Alternatively, the second electrical connector 120 can be fixedly attached to or integral with the substrates 108 and the frame 110. The second electrical connector 120 can include an internal circuit or wiring as well as terminals or electrical connections such that when it is engaged with the substrates 108 it makes an electrical connection between the strings of LEDs 106. In embodiments, where the second electrical connector 120 is removably coupled to the substrates 108 and frame 110, the second electrical connector 120 can be removably coupled to either an end of the frame 110 distal from the LED driver 102 (as shown) or an end of the frame 110 proximal to the LED driver 102 (not illustrated). In this way, the light run 104 can be engaged with the LED driver 102 from either end of the light run 104. In such an embodiment, there may be first light connectors 118 at each end of both of the substrates 108, such that the first electrical connectors 118 are arranged to make a mechanical and electrical engagement with both the LED driver 102 and the second electrical connector 120. In other words, in this embodiment, the second electrical connector 120 can be engaged with either end of the light run 104.

While the second electrical connector 120 is illustrated as coupling two strings of LEDs 106 to each other, in other embodiments (discussed below) the second electrical connector 120 could also make an electrical connection between adjacent ends of light runs 104 (e.g., see FIGS. 12-14). In other embodiments where light runs 104 are to be coupled end to end (e.g., see FIGS. 12-14), the first electrical connector(s) 118 can be shaped and arranged to make such electrical connections between light runs 104 without a second electrical connector 120.

Further, while the LED driver 102 is shown as only having an electrical input/output on a side facing the light run 104, in other embodiments, the LED driver 102 could have a plurality of electrical input/outputs, for instance, one on each of four sides of the LED driver 102, or one on two of the four sides. Such configurations could be useful, for instance, where multiple light runs are coupled to the LED driver 102 and each light run 104 is driven in parallel rather than serially (e.g., see a serially-driven string of light runs in FIGS. 12-14). Alternatively, providing electrical inputs/outputs on multiple sides of the LED driver 102 allows a single light run 104 or a set of serially-coupled light runs 104 to be coupled to the LED driver 102 in different arrangements, where the LED driver 102 may not have flexibility in its orientation.

Figure 7:
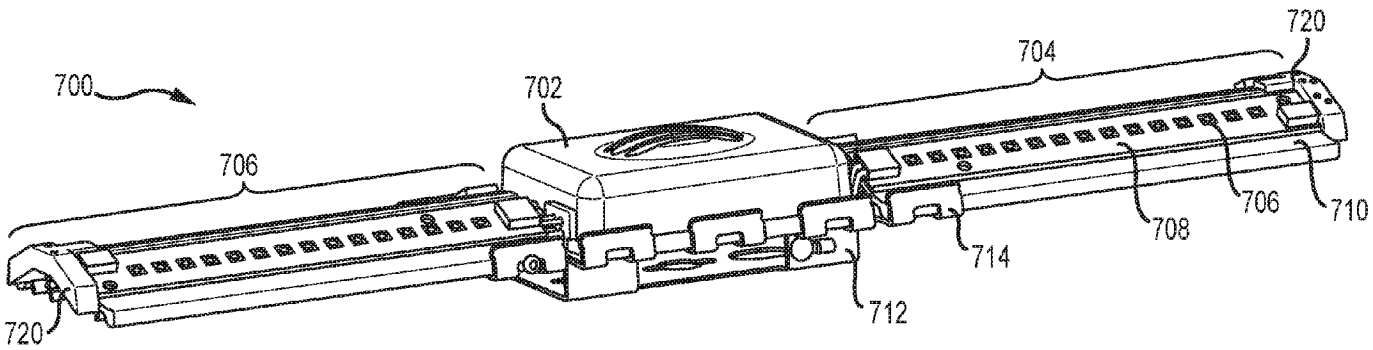
FIG. 7 illustrates an embodiment of a modular LED lighting system with an LED driver and two lights runs coupled to the LED driver.
Figure 8:
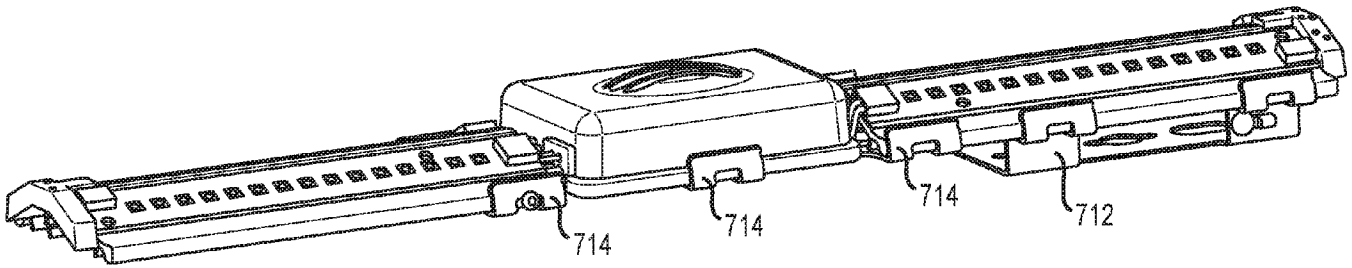
FIG. 8 illustrates the modular LED lighting system of FIG. 7 with an alternative position of the mounting bracket.
Figure 9:
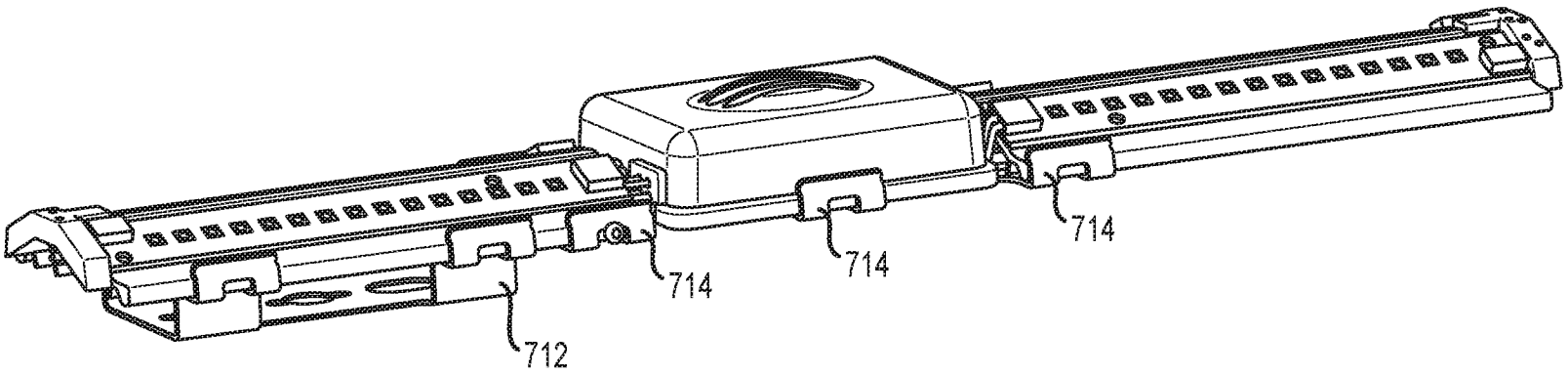
FIG. 9 illustrates the modular LED lighting system of FIG. 7 with yet another alternative position of the mounting bracket.

FIGS. 7-10 illustrate an embodiment of an LED lighting system 700 having an LED driver 702 and two light runs 704 and 706, each extending from opposing sides of the LED driver 702. Given the length of the LED driver 702 plus two light runs 704 and 706, there is an even greater selection of positions that the mounting bracket 712 can take relative to the LED driver 702 and light runs 704 and 706. For instance, FIG. 7 illustrates the mounting bracket 712 engaged with the LED driver 702 but not with the light runs 704, 706, while FIGS. 8 and 9 illustrate the mounting bracket 712 engaged with one of the light runs 704, 706, but not with the LED driver 702.

As with the single light run embodiments, the position of the LED driver 702 as well as its low profile, minimizes shadows that the LED driver 702 casts, and in the dual-light run embodiments, there is even less shadowing since the opposing light runs 704, 706 wash out each's shadow.

Figure 10:
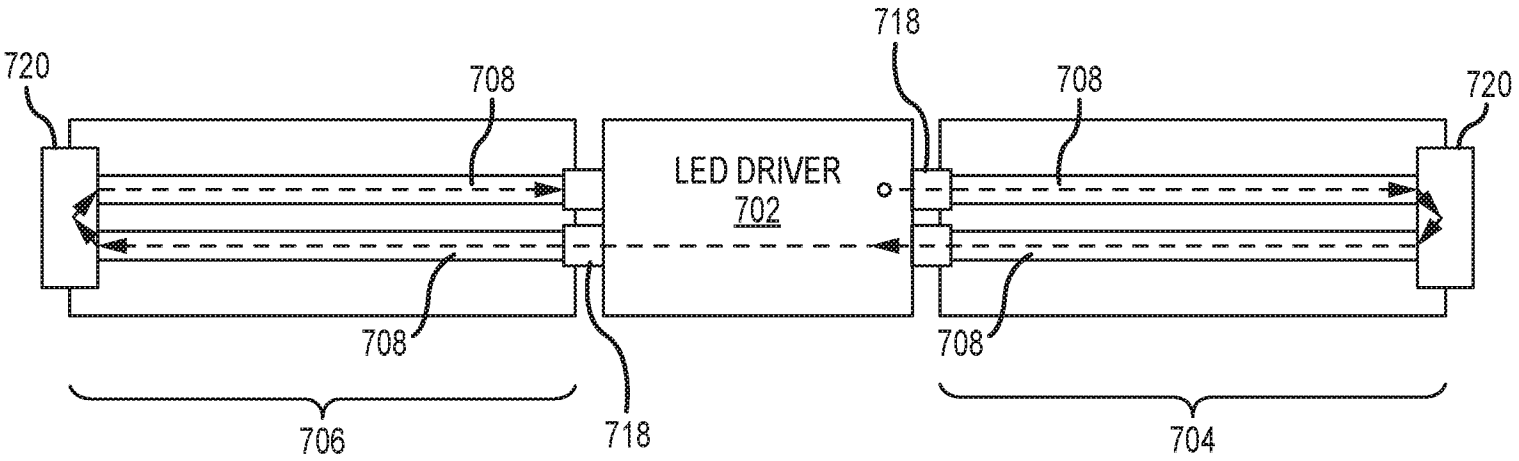
FIG. 10 illustrates an electrical path diagram for a modular LED lighting system having a single LED driver and two light runs, according to one embodiment of this disclosure.

In this configuration the LED driver 702 can include an electrical connection for each of the two light runs 704, 706, or a single electrical connection for the pair of light runs 704, 706. Where one electrical connection is used, an electrical path can pass from the LED driver 702 to a first substrate 708 of a first of the two light runs 704, through a second electrical connector 720, to a second substrate 708 of the first of the two light runs 704, under, through or around the LED driver 702, to a first substrate 708 of the second of the two light runs 706, through another second electrical connector 720, to a second substrate 708 of the second of the two light runs 706. This electrical path is illustrated in FIG. 10, and this electrical path and the associated connectors can be implemented in any of FIGS. 7-9.

Figure 11:
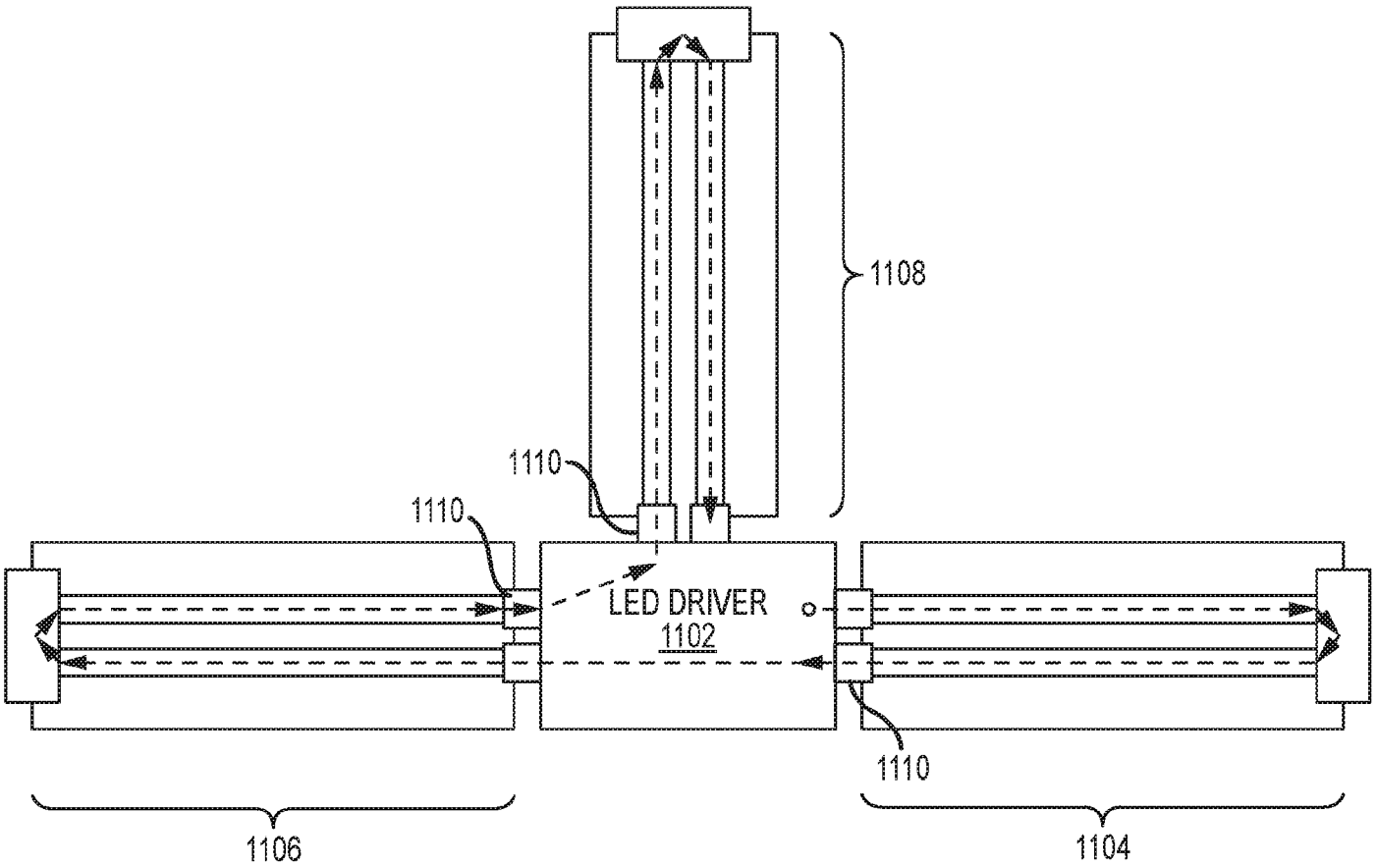
FIG. 11 illustrates an electrical path diagram for a modular LED lighting system having a single LED driver and three light runs, according to an embodiment of this disclosure.

FIG. 11 illustrates a further arrangement of modular light runs coupled to a single LED driver. In this embodiment, an LED driver 1102 is coupled to three light runs, 1104, 1106, and 1108. The light runs 1104, 1106, and 1108 are each coupled to one of three sides of the LED driver 1102. One can also envision that a fourth light run could be coupled to the fourth side of the LED driver 1102. The path of the dashed arrow shows one current path along LED strings that could be implemented. However, various other configurations of electrical connections between the strings of LEDs could be made without departing from the spirit of this disclosure.

In this embodiment, the mounting bracket (not illustrated) could again be configured to couple to a junction box or other attachment point(s) on the wall/ceiling, as well as be well as be configured to engage the LED driver 1102, one or more of the light runs 1104, 1106, 1108, or a combination thereof. For instance, this could enable the LED driver 1102 to be positioned over the junction box, or an end of a light run 1104, 1106, 1108 distal from the LED driver 1102 to be positioned over the junction box. The carrier (not illustrated) could slidably engage the LED driver 1102 and the three light runs 1104, 1106, 1108, thereby providing a structural connection between these four components.

Each of the light runs 1104, 1106, 1108 can include electrical connectors 1110 shaped to be removably or fixedly engaged with the LED driver 1102, thereby allowing the light runs 1104, 1106, 1108 to be moved to different positions on the LED driver 1102, or merely to be easily replaced, for instance if one light run 1104, 1106, 1108 goes bad. Each light run 1104, 1106, 1108 can also include a second electrical connector on an end distal from the LED driver 1102, that is engaged with an electrical contact of each string of LEDs, thereby forming a "U"-shaped current path in each light run 1104, 1106, 1108.

Figure 12:
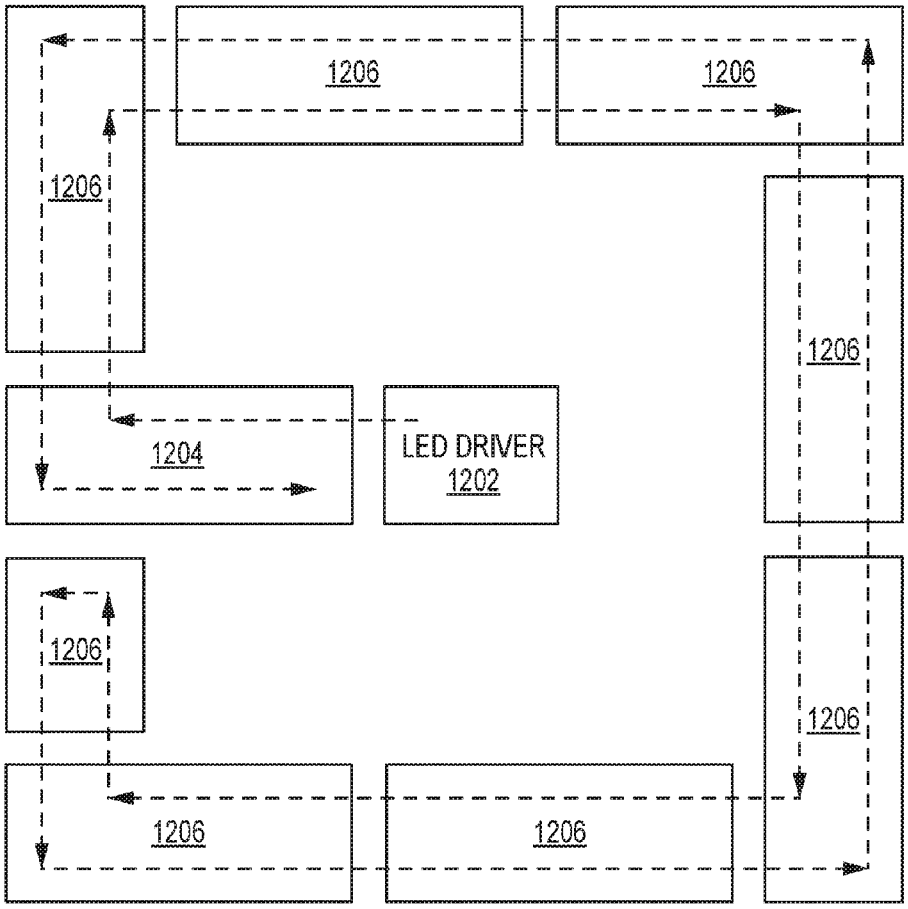
FIG. 12 illustrates an electrical path diagram for a modular LED lighting system having a single LED driver and nine light runs, according to another embodiment of this disclosure.

FIG. 12 illustrates a further embodiment of modular light runs coupled to a single LED driver in order to replicate a circular lighting system or a lighting system having a larger luminous area. The LED driver 1202 can be electrically coupled to a first light run 1204, which in turn can be coupled to the other light runs 1206 in a spiral fashion with the electrical connections eventually spiraling back and returning to terminate in a second string of LEDs in the first light run 1204. The dashed arrows shows one such path of LED strings and electrical connections. However, other arrangements of electrical connections can also be implemented, thereby forming myriad other current paths.

Figure 13:
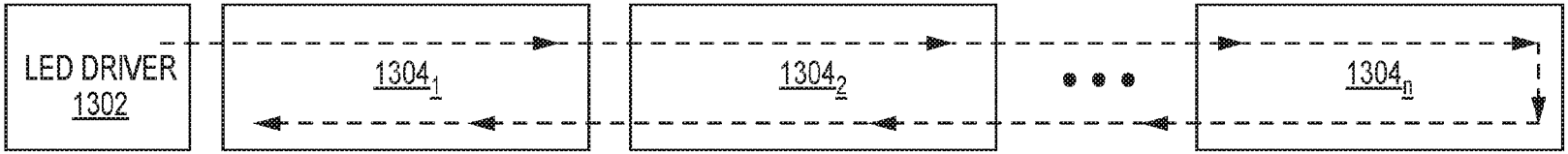
FIG. 13 illustrates an electrical path diagram for a modular LED lighting system having a single LED driver and a string of 1 through n light runs, according to yet another embodiment of this disclosure.

FIG. 13 illustrates a further embodiment of modular light runs coupled to a single LED driver. Here, the LED driver 1302 can be electrically coupled to a string of light runs $1304_1$, $1304_2$, . . . , $1304_n$, thereby forming the equivalent of an elongated lighting system having a customizable length. For instance, given appropriate form factors, this configuration could replace florescent bulbs such as T8 bulbs.

Figure 14:
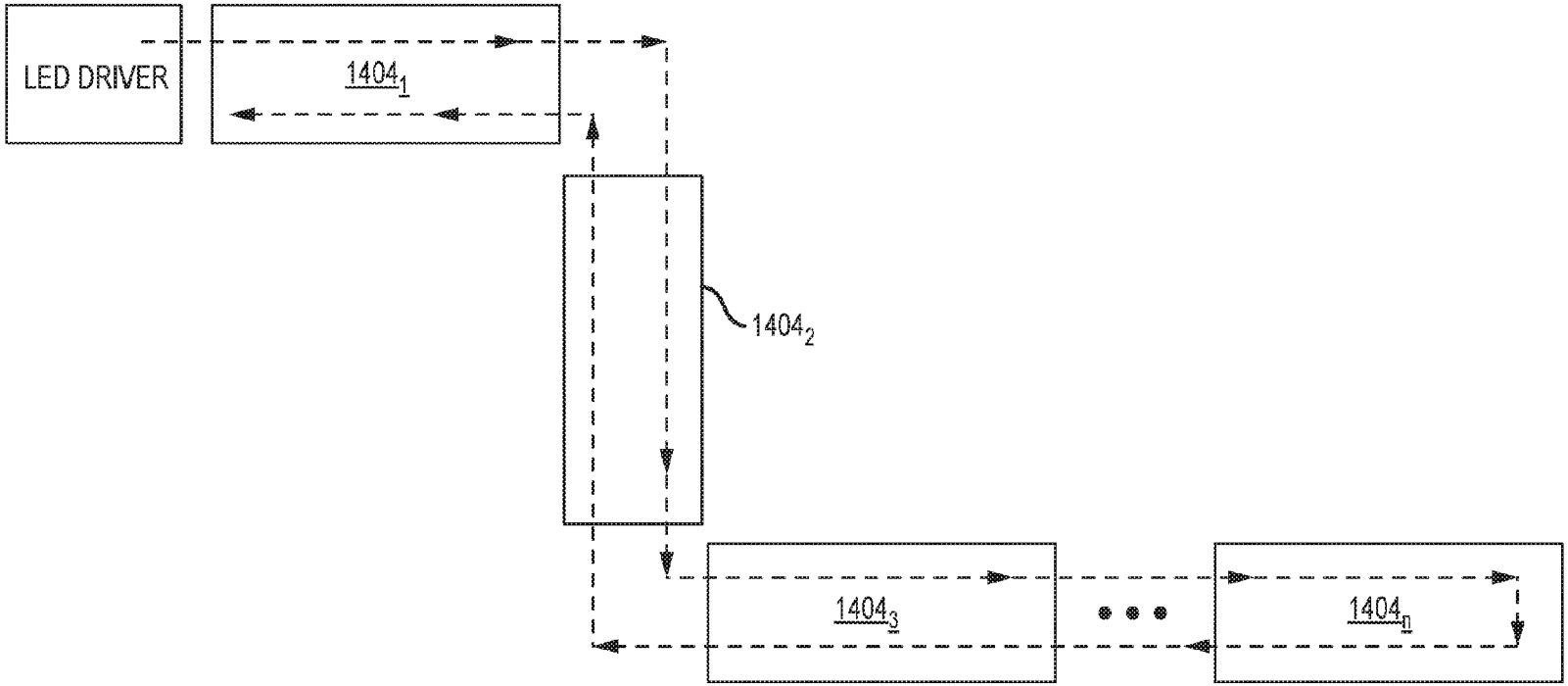
FIG. 14 illustrates an electrical path diagram for a modular LED lighting system having a single LED driver and a string of 1 through n light runs, according to another embodiment of this disclosure.

As illustrated in FIG. 14, such a string of light runs need not be linear, but rather can include one or more turns or angles. For instance, the illustrated strings of light runs $1404_1$, $1404_2$, $1404_3$, . . . $1404_n$, can include two 90° turns. However, one of skill in the art will recognize that more elaborate changes in direction could be utilized to form shapes, symbols, letters, etc., such as are found in neon signs.

Throughout this disclose the LED lighting systems have been described as having strings of LEDs arranged in parallel such that a single pair of input leads from the LED driver can drive any number of strings of LEDs without further connections back to the LED driver. However, other embodiments, may involve a series connection of LEDs or some other connection that involves a second connection back to the LED driver, thereby forming a current loop with the LED driver. While such embodiments have not been shown nor described in detail, those of skill in the art will easily recognize how to implement such variations of this disclosure without undue experimentation.

FIGS. 15-17 illustrate views of two embodiments of an LED lighting system 1500 including a mounting post 1502. The mounting post 1502 can be configured to attach the LED lighting system 1500 to a junction box. The mounting post 1502 can create a separation or gap between the LED lighting system 1500 and the wall/ceiling. The mounting post 1502 can couple to the mounting bracket 1512, and electrical wires from the junction box can run through the mounting post 1502 and to the LED driver, thereby providing mechanical and electrical protection from the wires to users and installers.

Figure 18:
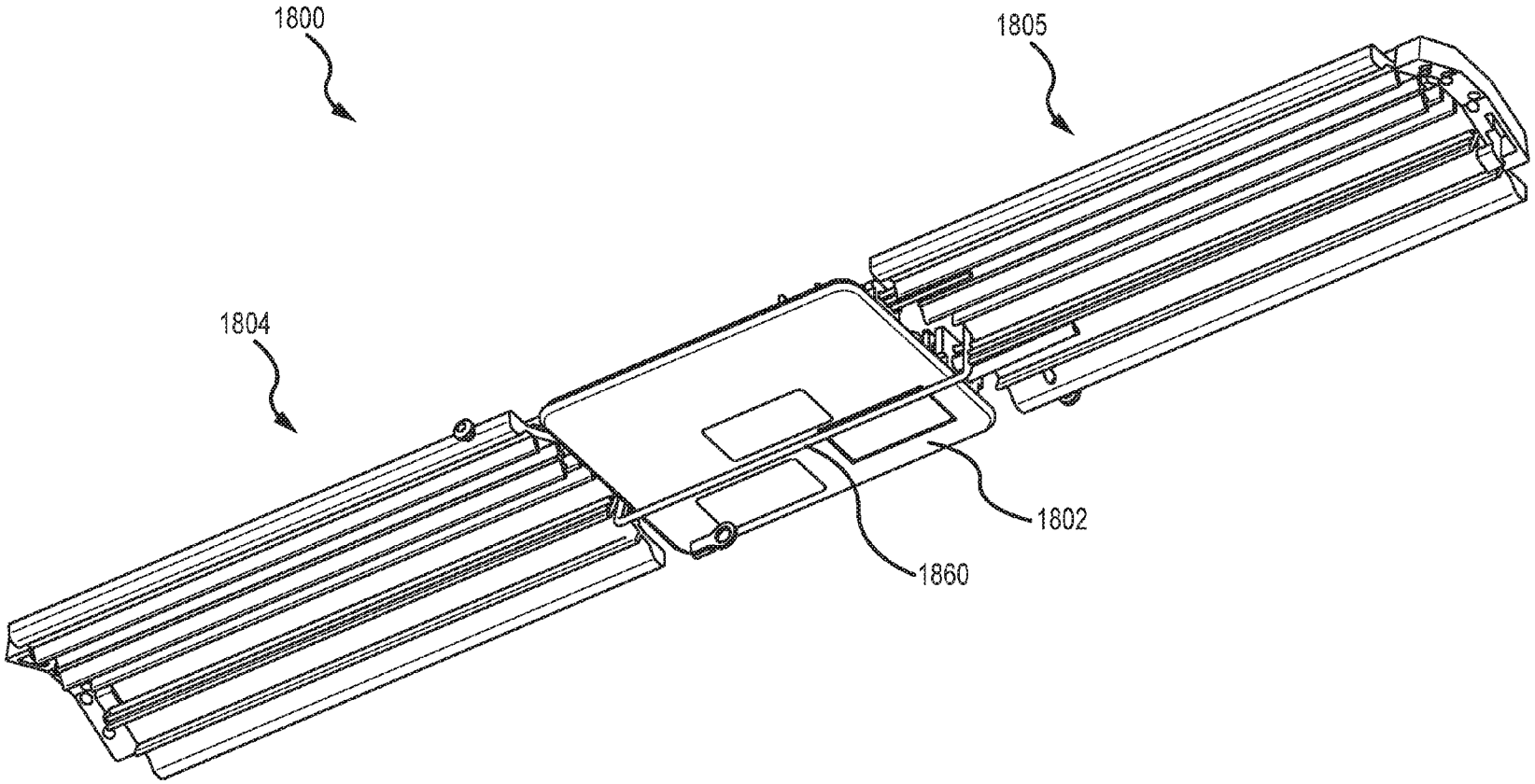
FIG. 18 illustrates an underside view of an embodiment of a modular LED lighting system having an LED driver, and two light runs electrically coupled via an electrical run below the LED driver.

FIG. 18 illustrates an underside of an LED lighting system 1800 having two light runs 1804, 1805 and showing one embodiment of an electrical connection between the two light runs 1804, 1805. One can see an electrical wire or conduit 1860 passing from a substrate (not visible) of the first light run 1804 to a substrate (not visible) of the second light run 1805, passing below the LED driver 1802 en route. In some embodiments, the electrical wire or conduit 1860 can be affixed to a bottom of the LED driver 1802 while in other embodiments, it can be integrally formed with the LED driver 1802. FIG. 18 does not show a mounting bracket or carrier, although one of skill in the art will recognize via other figures in this disclosure, how a carrier and mounting bracket would be engaged with the LED lighting system 1800.

Figure 19:
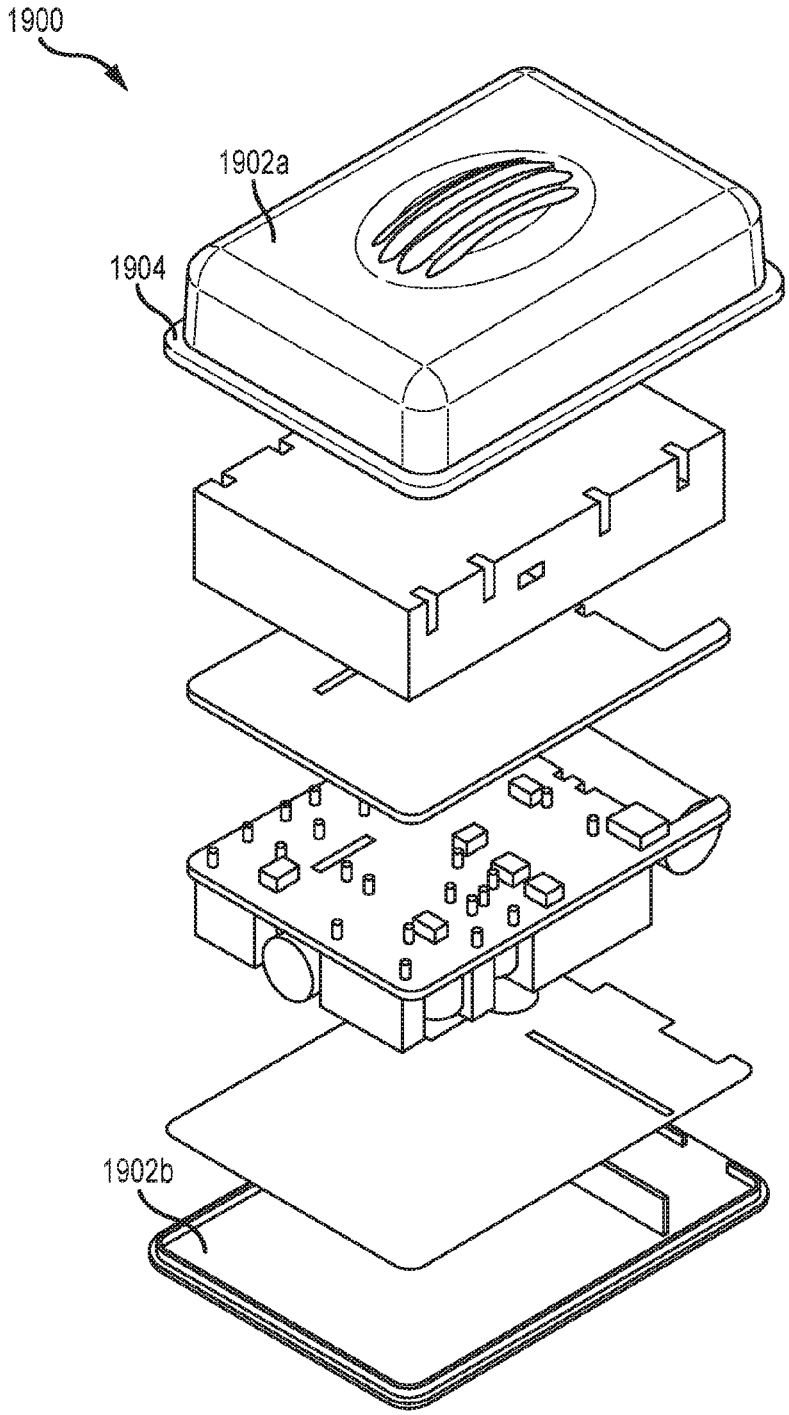
FIG. 19 illustrates an exploded view of an LED driver, according to one embodiment of this disclosure.

FIG. 19 illustrates an exploded view of an embodiment of an LED driver. The LED driver 1900 can have a low profile, meaning that its height is less than either its width or its length, or less than both its length and its height. Further, the LED driver 1900 can include an LED driver casing 1902 encasing various portions of the LED driver 1900 including electronic components including those for thermal foldback and dimming. The LED driver casing 1902 can include an upper half 1902*a* and a lower half 1902*b*. The upper half 1902*b* can include an elongated mounting flange 1904 that is arranged on at least two sides of the LED driver 1900, although in this illustration, the mounting flange 1904 is shown as encircling the LED driver 1900 on all four sides. The mounting bracket 112 and the carrier 114 illustrated in FIGS. 1-4 can removably engage with the mounting flange 1904. In some embodiments, the mounting flange 1904 can be substantially rigid while the mounting bracket 112 and the carrier 114 can include deformable mounting points that can deform when pressed against the mounting flange 1904, and can deform enough to enable the mounting points to snap around and then engage with the mounting flange 1904.

While only a single LED driver has been described and illustrated throughout this disclosure, in some embodiments, multiple LED drivers can be implemented.

Figure 20:
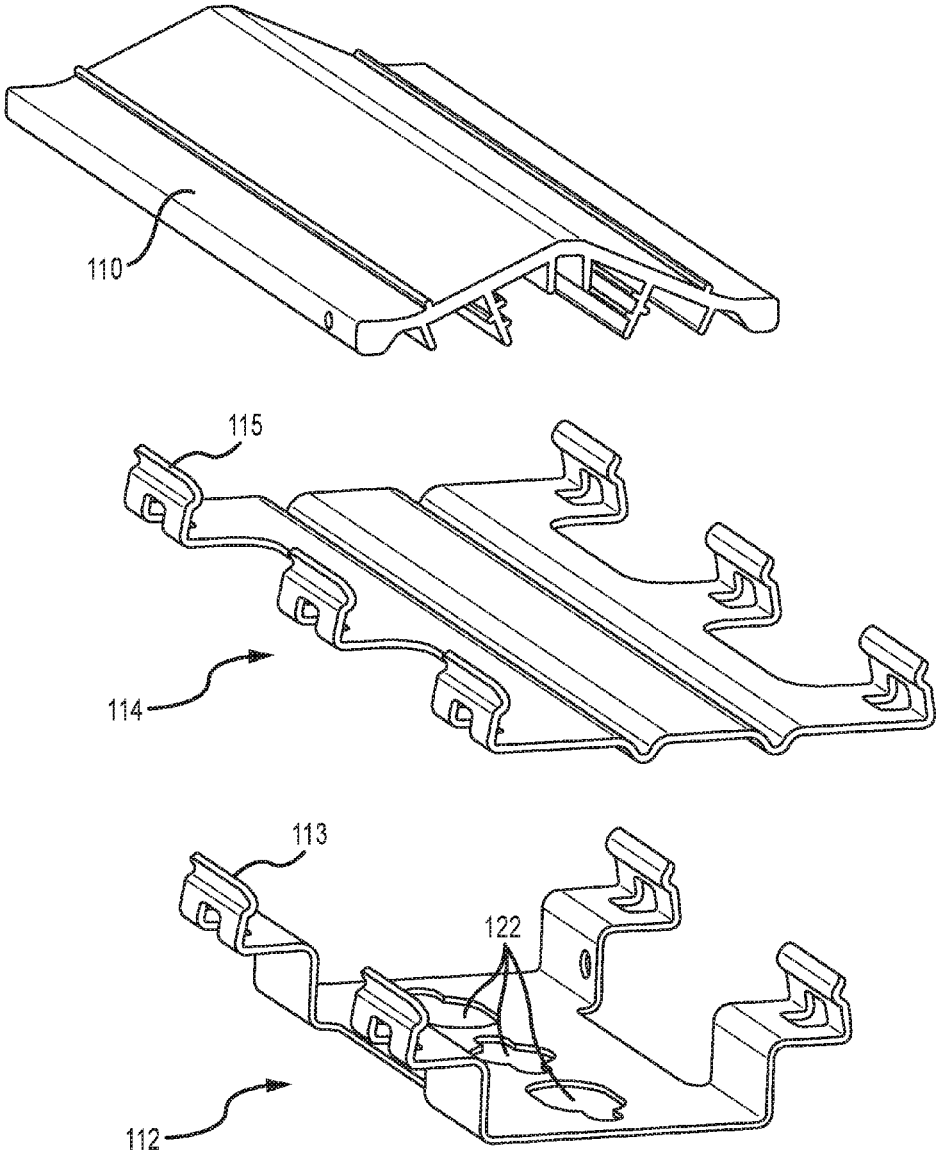
FIG. 20 illustrates a view of a frame, carrier, and mounting bracket for an LED lighting system, according to one embodiment of this disclosure.

FIG. 20 illustrates a view of the frame 110, the mounting bracket 112, and the carrier 114 in isolation. Here, the six mounting points 115 of the carrier 114 and the four mounting points 113 of the mounting bracket 112 are more clearly visible.

Figure 21:
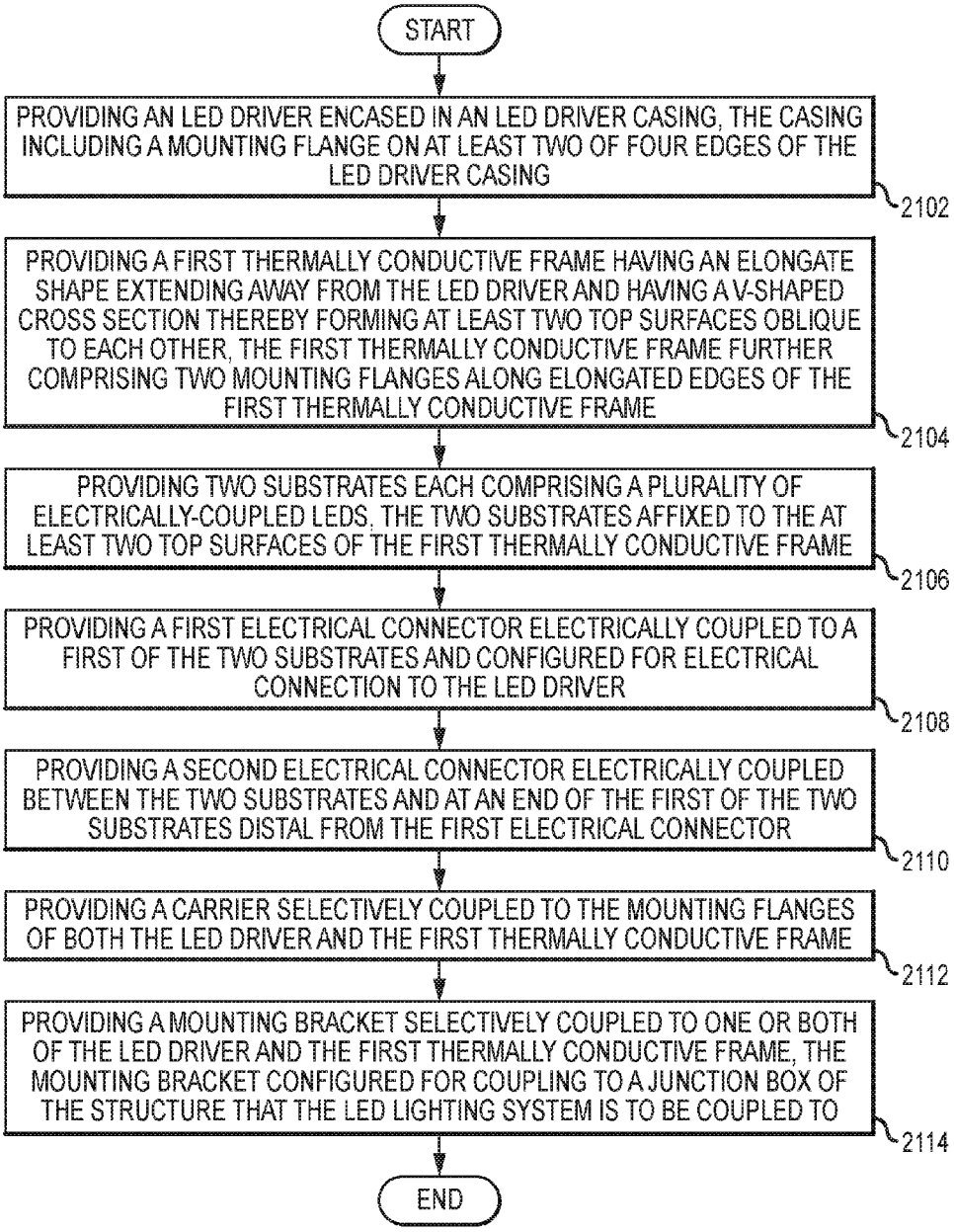
FIG. 21 illustrates a method illustrates a method of providing an LED lighting system.

FIG. 21 illustrates a method of providing an LED lighting system. The method 2100 can include providing an LED driver encased in an LED driver casing, the casing including an elongated mounting flange on at least two of four edges of the LED driver casing (Block 2102). The method 2100 can also include providing a first thermally conductive frame having an elongate shape extending away from the LED driver and having a V-shaped cross section, thereby forming at least two top surfaces oblique to each other (Block 2104). The first thermally conductive frame can further include two elongated mounting flanges along elongated edges of the first thermally conductive frame. The method 2100 can further include providing two substrates each comprising a plurality of electrically-coupled LEDs (Block 2106). The two substrates can be affixed to the at least two top surfaces of the first thermally conductive frame. The method 2100 can further include providing a first electrical connector electrically coupled to a first of the two substrates and configured for electrical connection to the LED driver (Block 2108). The method 2100 can also include providing a second electrical connector electrically coupled between the two substrates and at an end of the first of the two substrates distal from the first electrical connector (Block 2110). The method 2100 can further include providing a carrier removably coupled to the elongated mounting flanges of both the LED driver and the first thermally conductive frame (Block 2112). The method 2100 can also include providing a mounting bracket removably coupled to one or both of the LED driver and the first thermally conductive frame (Block 2114). The mounting bracket can be configured for coupling to a junction box of a structure that the LED lighting system is to be coupled to.

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. An LED lighting system comprising:

an LED driver encased in an LED driver casing, the casing including an elongated mounting flange on at least two of four edges of the LED driver casing;

a first thermally conductive frame having an elongate shape extending away from the LED driver and having a V-shaped cross section, thereby forming at least two top surfaces oblique to each other, the first thermally conductive frame further comprising two elongated mounting flanges along elongated edges of the first thermally conductive frame;

two substrates each comprising a plurality of electrically-coupled LEDs, the two substrates affixed to the at least two top surfaces of the first thermally conductive frame;

a first electrical connector electrically coupled to a first of the two substrates and configured for electrical connection to the LED driver;

a second electrical connector electrically coupled between the two substrates and at an end of the substrates distal from the first electrical connector;

a carrier removably coupled to the elongated mounting flanges of both the LED driver and the first thermally conductive frame; and a mounting bracket removably engaged with one or both of the LED driver and the first thermally conductive frame, thereby providing a rigid orientation between the LED driver and the first thermally conductive frame, the mounting bracket configured for coupling to a junction box.

2. The system of claim 1, further comprising:

a second thermally conductive frame extending away from the LED driver and having a V-shaped cross section thereby forming at least two top surfaces oblique to each other, the second thermally conductive frame further comprising two elongated mounting flanges along elongated edges of the second thermally conductive frame, wherein the carrier is removably coupled to the elongated mounting flanges of the LED driver and both the first and second thermally conductive frames;

the mounting bracket is removably coupled to one or more of the LED driver, the first thermally conductive frame, and the second thermally conductive frame.

3. The system of claim 2, further comprising an electrical connection between the first and second thermally conductive frames.

4. The system of claim 2, wherein the LED driver has four elongated mounting flanges, each of the four elongated mounting flanges being oblique to at least two other of the four elongated mounting flanges.

5. The system of claim 1, wherein a volume between the frame and the carrier is shaped to encase one or more electrical wires.

6. A method of providing an LED lighting system, the method comprising:

providing an LED driver encased in an LED driver casing, the casing including an elongated mounting flange on at least two of four edges of the LED driver casing;

providing a first thermally conductive frame having an elongate shape extending away from the LED driver and having a V-shaped cross section thereby forming at least two top surfaces oblique to each other, the first thermally conductive frame further comprising two elongated mounting flanges along elongated edges of the first thermally conductive frame;

providing two substrates each comprising a plurality of electrically-coupled LEDs, the two substrates affixed to the at least two top surfaces of the first thermally conductive frame;

providing a first electrical connector electrically coupled to a first of the two substrates and configured for electrical connection to the LED driver;

providing a second electrical connector electrically coupled between the two substrates and at an end of the two substrates distal from the first electrical connector;

providing a carrier removably coupled to the elongated mounting flanges of both the LED driver and the first thermally conductive frame; and providing a mounting bracket removably engaged with one or both of the LED driver and the first thermally conductive frame, the mounting bracket configured for coupling to a junction box.

7. The method of claim 6, further comprising providing:

a second thermally conductive frame extending away from the LED driver and having a V-shaped cross section thereby forming at least two top surfaces oblique to each other, the second thermally conductive frame further comprising two elongated mounting flanges along elongated edges of the second thermally conductive frame, wherein the carrier is removably coupled to the elongated mounting flanges of the LED driver and both the first and second thermally conductive frames;

the mounting bracket is removably coupled to one or more of the LED driver, the first thermally conductive frame, and the second thermally conductive frame.

8. The method of claim 7, further comprising providing an electrical connection between the first and second thermally conductive frames.

9. The method of claim 6, further comprising running one or more electrical wires within a volume between the frame and carrier.

10. An LED lighting system comprising:

an LED driver including elongated mounting flanges;

a first thermally conductive frame having an elongate shape and having a V-shaped cross section and two oblique top surfaces, the first thermally conductive frame further comprising two elongated mounting flanges parallel to a longitudinal axis of the thermally conductive frame;

two sets of electrically-coupled LEDs affixed to the two oblique top surfaces of the thermally conductive frame;

a first electrical connector affixed to the first thermally conductive frame and configured to provide a removable electrical connection between one of the two sets of electrically-coupled LEDs and the LED driver;

a second electrical connector removably coupled to the two sets of electrically-coupled LEDs, thereby forming an electrical connection between the two sets of electrically-coupled LEDs, the second electrical connector arranged on an opposing end of the frame from the first electrical connector;

a carrier removably coupled to the elongated mounting flanges of both the LED driver and the first thermally conductive frame, thereby providing a rigid orientation between the LED driver and the first thermally conductive frame; and a mounting bracket removably coupled to one or both of the LED driver and the first thermally conductive frame, the mounting bracket configured for coupling to a junction box.

11. The system of claim 10, further comprising:

a second thermally conductive frame extending away from the LED driver and having a V-shaped cross section, thereby forming at least two top surfaces oblique to each other, the second thermally conductive frame further comprising two elongated mounting flanges along elongated edges of the second thermally conductive frame, wherein the carrier is removably coupled to the elongated mounting flanges of the LED driver and both the first and second thermally conductive frames;

the mounting bracket is removably coupled to one or more of the LED driver, the first thermally conductive frame, and the second thermally conductive frame.

12. The system of claim 11, further comprising an electrical connection between the first and second thermally conductive frames.

13. The system of claim 11, wherein the LED driver has four elongated mounting flanges, each of the four elongated mounting flanges being oblique to at least two other of the four elongated mounting flanges.

14. The system of claim 10, wherein a volume between the frame and the carrier is shaped to encase one or more electrical wires.

15. The system of claim 10, wherein either end of the frame can be removably coupled to the second electrical connector.

* * * * *